United States Patent [19]

D'Alessio et al.

[11] Patent Number: 4,541,509

[45] Date of Patent: Sep. 17, 1985

[54] SHORING FRAME

[75] Inventors: Michael S. D'Alessio, Flushing, N.Y.; Richard C. Mocny, Kinnelon, N.J.

[73] Assignee: Harsco Corporation, Camp Hill, Pa.

[21] Appl. No.: 409,729

[22] Filed: Aug. 20, 1982

Related U.S. Application Data

[63] Continuation of Ser. No. 339,726, Jan. 15, 1982, abandoned.

[51] Int. Cl.[4] ..... E04G 1/14

[52] U.S. Cl. ..... 182/179; 52/637

[58] Field of Search ..... 182/178, 179; 52/637, 52/638

[56] References Cited

U.S. PATENT DOCUMENTS

| | | | |
|---|---|---|---|
| 2,561,599 | 7/1951 | Squire | 182/179 |
| 2,574,409 | 11/1951 | North | 182/178 |
| 2,925,921 | 2/1960 | DePew | 182/179 |
| 2,988,180 | 6/1961 | Campbell | 52/637 |
| 3,407,559 | 10/1968 | Durand | 52/637 |
| 3,474,588 | 10/1969 | Otto | 52/690 |

FOREIGN PATENT DOCUMENTS

| | | |
|---|---|---|
| 944749 | of 1974 | Canada . |
| 1062683 | of 1979 | Canada . |
| 1062684 | of 1979 | Canada . |
| 1684226 | of 1968 | Fed. Rep. of Germany . |
| 2556365 | of 1975 | Fed. Rep. of Germany . |

*Primary Examiner*—Reinaldo P. Machado
*Attorney, Agent, or Firm*—Curtis, Morris & Safford

[57] ABSTRACT

A right-angled triangular shoring or scaffolding frame unit having its acute apices blunted at right angles to the adjacent side and having multiple holes therein adapted for bolt assembly in a plurality of positions. Said triangular units preferably are made from aluminum and used in identical pairs assembled symmetrically to brace a pair of vertical load-bearing aluminum legs, said triangular units having adjacent legs of different lengths whereby the widths of the assembled frames can be varied by bolting the pair(s) of triangular units to each other edge-to-edge between the vertical legs with either the shorter, or alternatively the longer, of the adjacent legs oriented horizontally.

31 Claims, 16 Drawing Figures

FIG. 5
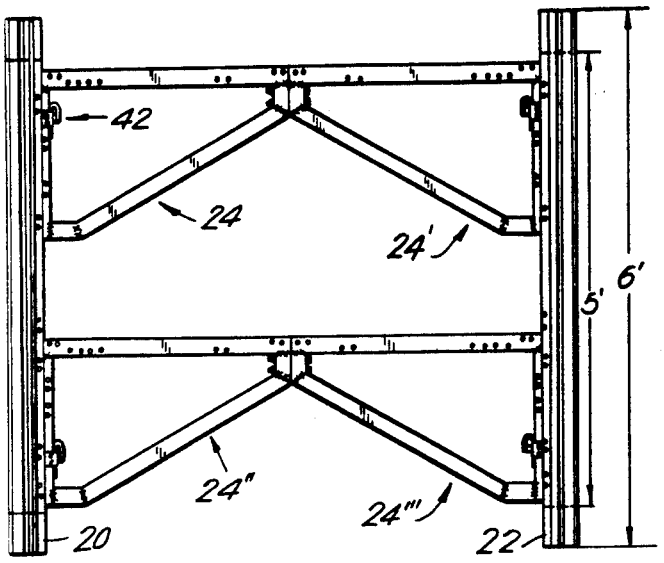
FIG. 6
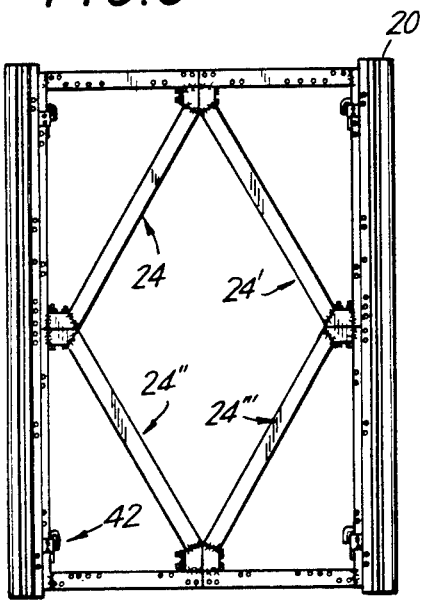
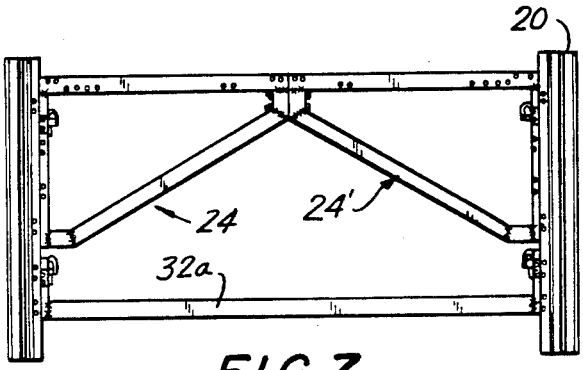
FIG. 7
FIG. 8
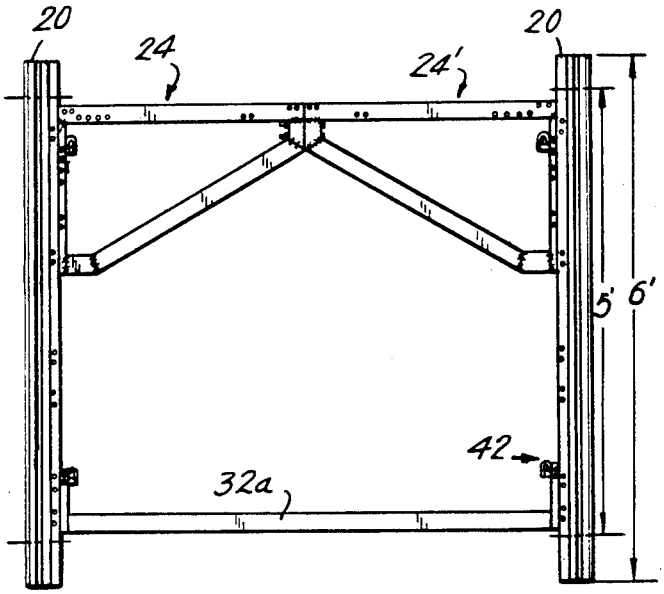

SHORING FRAME

This is a continuation of patent application Ser. No. 339,726 filed Jan. 15, 1982 and now abandoned.

This invention relates to a versatile shoring frame of the type utilized in the construction industry preferably made from aluminum or similar light weight non-ferrous metals. It is also adaptable for use in scaffolding and other similar frames useful in the construction and similar industries.

An example of conventional steel shoring, adapted for use with extendable frames, is illustrated in U.S. Pat. No. 3,190,405, issued June 22, 1965. Welded steel shoring base frames have long been the conventional standard in the construction industry. Mechanically assembled shoring frames have been generally thought to be less desirable, but nonetheless have found acceptance in various forms. Similarly, in recent years the use of aluminum in shoring equipment has found some favor on the basis of more convenient light-weight handling with resultant labor-saving costs on larger construction jobs. Among the known prior art are bolted steel shoring frames wherein the legs have welded-on tabs to which are bolted (from the four corners thereof) a rectangularly shaped bracing element having diamond shaped internal bracing within the rectangle. This system was designed so that the rectangle could be bolted to the legs via the tabs in either the vertical or horizontal direction, thus giving a two-width option on assembly. This system had several drawbacks including the usual concern about loosening of bolts. Storage of this design was not particularly compact because of the large size rectangle involved. The manufacture was quite costly, particularly in view of the welded-on plurality of the tabs.

More recently there exist bolted aluminum shoring frames, for example utilizing Z-shaped bracing requiring special fittings for bolting to the leg and not having the versatility of variable widths. Such asymmetrical frames are particularly difficult to design and successfully make and use because of the need to hold close tolerances with these holes; and the potential for hole elongation. The resulting "racking" in stacked shoring frames will result in derating the load capacity of such a system.

It is an object of the present invention to provide apparatus for successfully incorporating the foregoing advantages and avoiding the disadvantages; and more particularly, to provide such a device in the form of a bolted shoring frame, preferably made of aluminum, having great versatility in adjustability of widths, and having high rated capacity; being light-weight; being capable of being shipped dismounted with resulting comparatively low bulk for substantial cost savings; having the advantage of replacement of individual components without having to scrap the whole frame; and being advantageously and uniquely developed from many already existing components not requiring specialized fittings or substantial development and retooling costs.

These and other objects will become apparent from the following description of the invention.

In this specification and in the accompanying drawings, we have shown and described preferred embodiments of our invention and have suggested various alternatives and modifications thereof; but it is to be understood that these are not intended to be exhaustive and that many other changes and modifications can be made within the scope of the invention. The suggestions herein are selected and included for purposes of illustration in order that others skilled in the art will more fully understand the invention and the principles thereof and will thus be enabled to modify it in a variety of forms, each as may be best suited to the conditions of a particular use.

BRIEF DESCRIPTION OF THE DRAWINGS

FIG. 5 is a view similar to FIG. 1 on a smaller scale showing the use of two pairs of braces for heavy duty use;

FIGS. 6 to 9 are similar to FIG. 5 but show modifications in the orientation of the braces to achieve different heights and widths, all showing the versatility of the basic triangular brace unit;

In co-pending applications filed by applicants' coworkers, there were disclosed aluminum shoring frames having extruded legs with longitudinal integral parallel flages formed therewith. The purpose of these flanges was specifically for improved welding techniques. This method, and apparatus using this method, are described in application Ser. No. 187,520, filed Sept. 15, 1980, and in application Ser. No. 298,474, filed Sept. 1, 1981.

Applicants have surprisingly seized upon the unique idea of utilizing the structure developed for welding instead for a versatile bolted shoring frame system employing at least one pair of identical triangular braces. According to the present invention, these triangular braces have been designed so as to be combinable in various different orientations to give considerable versatility to the size and rating strengths achievable with a minimum of parts. These triangular braces can be utilized exclusively or together with horizontal beam braces or the like.

Figure 1:
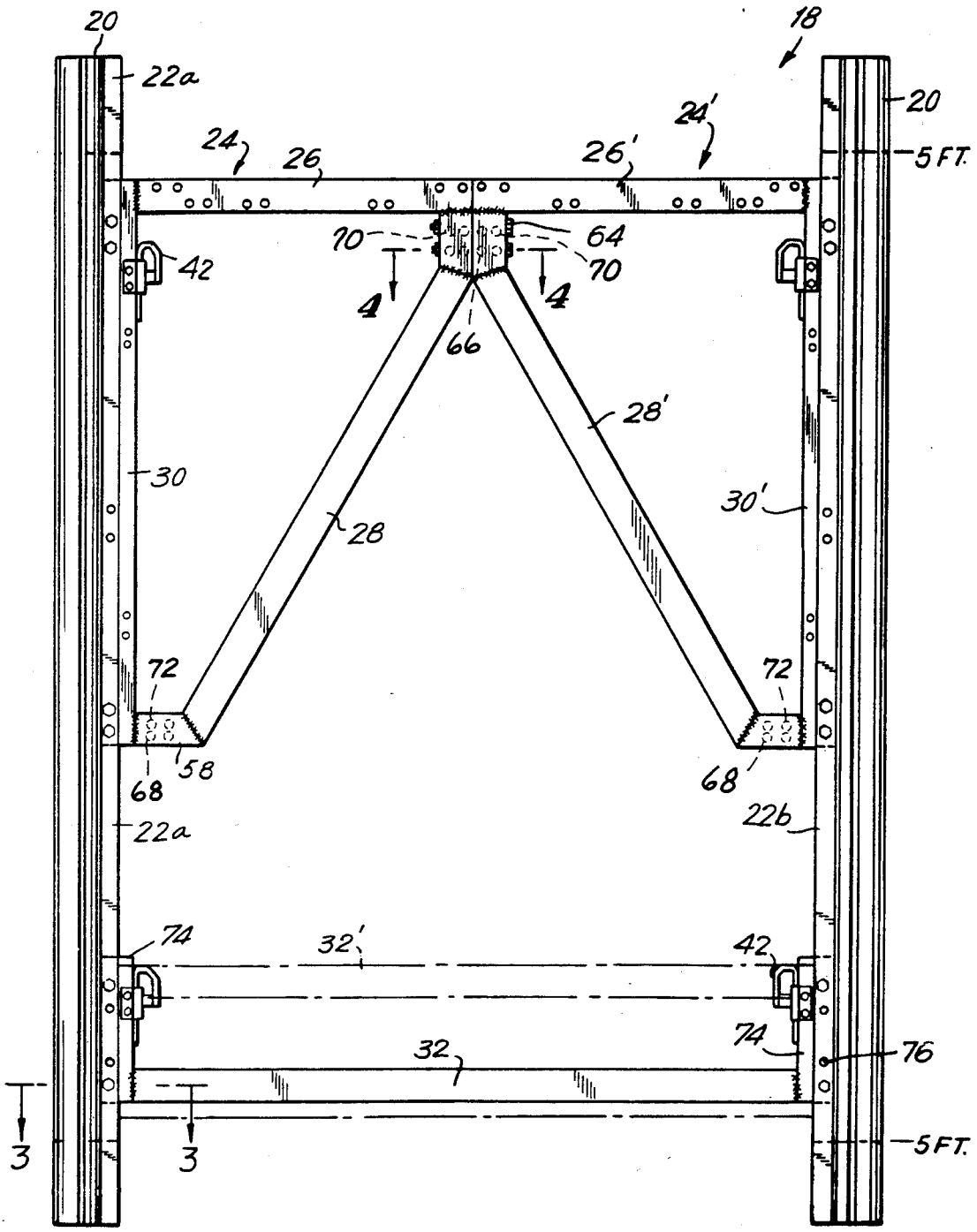
FIG. 1 is a front elevational view of a preferred embodiment of the present invention showing a bolted shoring frame in the four foot wide and six foot high configuration.
Figure 2:
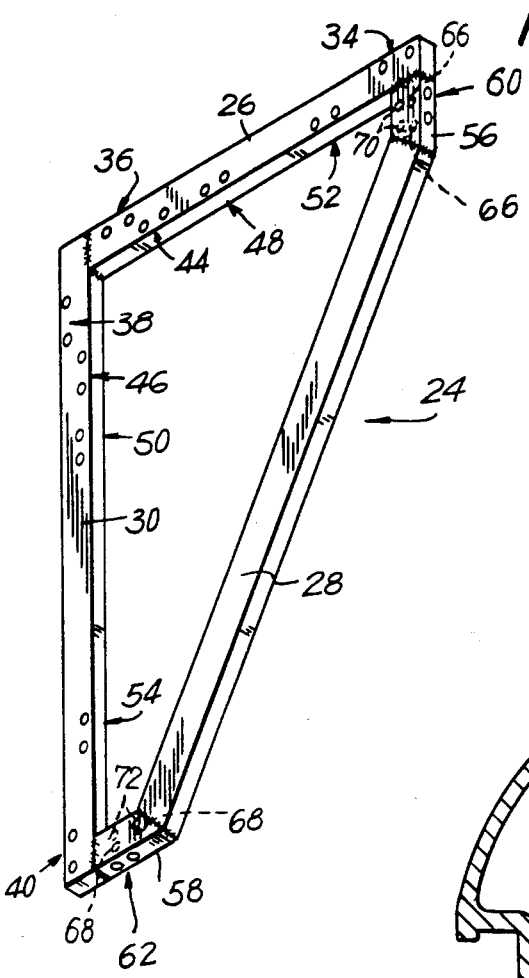
FIG. 2 is a perspective view of a right triangular non-isosceles brace showing a preferred embodiment of an inventive element of the shoring frame illustrated in FIG. 1.
Figure 3:
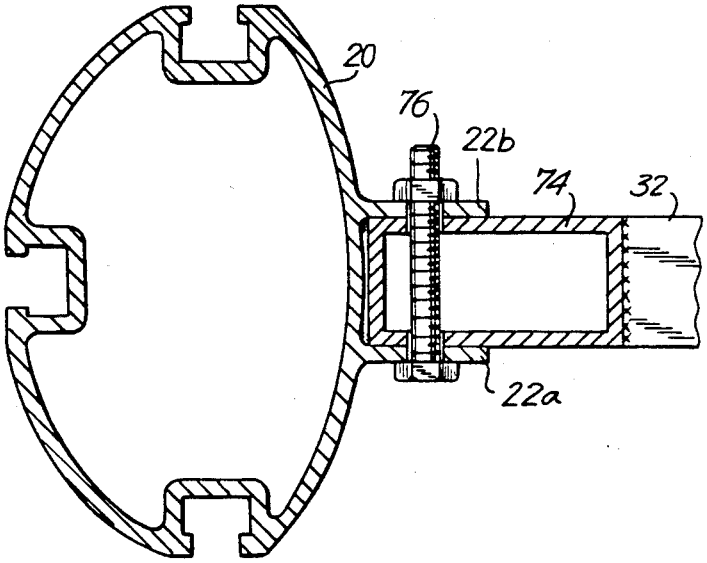
FIG. 3 is a cross-sectional view taken along line 3—3 of FIG. 1 particularly showing the joinder of the brace to the integral parallel flanges of the shoring frame leg.

Referring first to FIGS. 1 to 3, it will be seen that the frame legs 20 are formed with a pair of parallel flanges 22 (differentiated as 22*a* and 22*b*).

The particular shape of the leg is not critical and may be conventionally round or may take the shape shown in FIG. 3, or any other appropriate shape. See applicants' co-pending joint application Ser. No. 298,474 for a detailed discussion of the particular shape shown and the advantages thereof.

A basic aspect of applicants' invention is the right triangular brace 24. As particularly illustrated, this is in itself uniquely inventive. This brace 24 is most advantageously made from aluminum and is designed to be symmetrically aligned with an identical brace 24' to give an effective cross beam brace with angular knee braces. Thus referring to FIG. 1, the short leg 26 is aligned with and bolted to the corresponding short leg 26' of the symmetrically aligned triangular brace 24' to give an effective horizontal beam brace. The hypotenuse members 28 and 28' function as knee braces in the assembly as shown in FIG. 1. The longer legs 30 and 30' complete the triangle giving the triangular brace its structural integrity and strength and in the orientation shown in FIG. 1 are utilized to fasten the brace to the respective leg 20.

The brace is preferaby made entirely of aluminum rectangular tubing. By reason of the extrusion process, the flanges 22 run the length of the legs 20 and therefore fastening means such as bolts can be positioned anywhere theralong so long as there is sufficient spacing between adjacent bolts. Therefore as an added safety precaution each fastening point is preferably formed with a pair of bolts through corresponding bolt holes in the flange mating with bolt holes through the legs of the brace.

Comparing FIGS. 1 and 8, it can be seen that the respective pair of braces 24, 24' can be rotated to give a wider bracing member. Thus if the legs 26 and 30 of the brace are approximately respectively 2 feet and 3 feet, one can modify the frame to a width of between 4 and 6 feet. The lower beam brace beam 32 can either be formed as an extendable member, or as illustrated merely be replaced by a longer beam member 32*a*.

Referring again to FIG. 2, it will be seen that on the outer portion of each leg 26 or 30 (where the flange 22 overlaps such leg; compare overlap of stub 74 in FIG. 3) a pair of holes is drilled at either end of said legs 26 and 30. Each pair of such holes is respectively identified as 34, 36, 38 and 40, numbered counterclockwise in FIG. 2. The remaining bolt holes on legs 26 and 30 are for securing the slide lock fastener 42 (see FIGS. 10 to 12). These are attached in conjunction with respective legs 20 for securing cross-bracing between one shoring frame 18 and an adjacent shoring frame. Bolt holes 44 and 46 adjacent to the right angle are for use with longer legs 20 (such as on five or six foot high frames, e.g. see FIGS. 1, 5, and 8). The adjacent pairs of holes 48 and 50 are for use with the shorter frame legs 20 (such as on three and a half foot high frames, see FIG. 9). The pairs of holes 52 and 54 are for use in securing the fasteners 42 for joining the cross-bracing to the lower portion of the frame of the latter shorter type.

Figure 4:
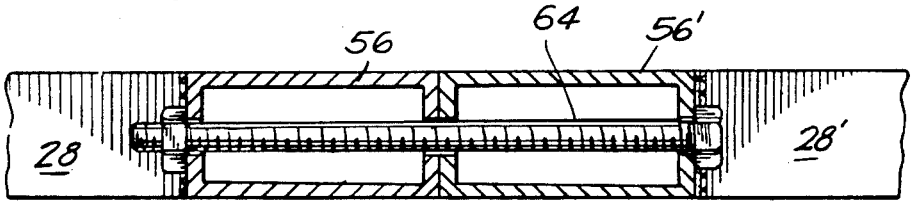
FIG. 4 is a cross-sectional view taken along line 4—4 of FIG. 1 showing the joinder at the blunted apices of a symmetrically joined pair of braces according to the present invention.

In order to permit the triangular braces 24, 24' to be symmetrically bolted together with one pair of legs aligned and with the other pair of legs parallel (for bolting to respective frame legs 20), the apices of the triangular braces opposite the right angle thereof are blunted so as to form short blunted portions 56 and 58, respectively adjacent to legs 26 and 30. Pairs of lateral holes 60 and 62 are formed respectively through each of said portions 56 and 58 whereby said braces 24 and 24' can be symmetrically joined by bolts 64 (see particularly FIGS. 1 and 4).

As shown in FIGS. 13 to 16, these braces 24 and 24' utilized in pairs can be symmetrically joined individually between frame legs 20 if holes 66, 68 are formed in the outer part of said blunted portions 56 and 58 respectively (shown in dotted outline in FIG. 2). Similarly, on the inner part of the same blunted portions 56, 58 can be formed respectively holes 70, 72 for use in mounting said slide locks 42. In the situation where the blunted portions 56, 58 would have six relatively closely spaced holes, these portions would preferably be made from solid aluminum, rather than aluminum tubing.

Figure 9:
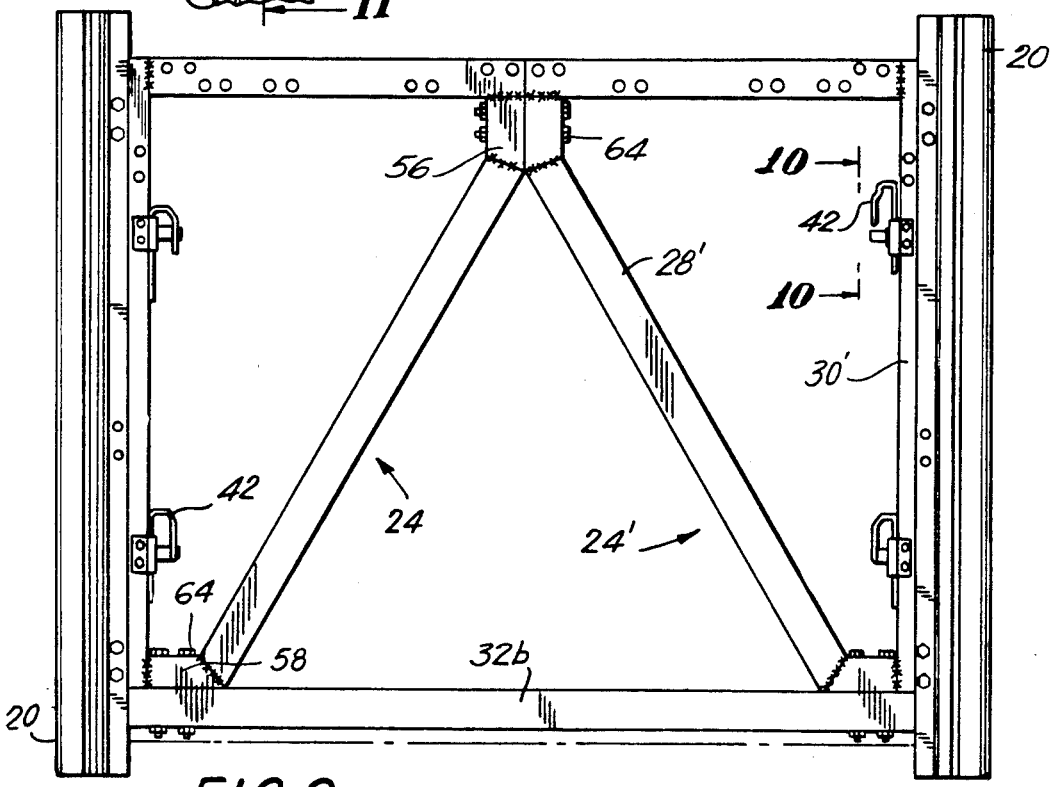

The holes illustrated in the flanges 22 of leg 20 in FIG. 1 are such as to accommodate any of the configurations shown in FIGS. 1, 5, or 8. Similarly, the hole orientation along flanges 22 in FIG. 9 are compatible with either the orientation shown in FIG. 7 or 9. The configuration in FIGS. 5 and 6 are particularly strong (and the latter has the advantage of providing a "walk through" feature, which is also partially true of the configurations in FIGS. 1 and 8).

Beam brace 32 in FIG. 1 can be made thicker (as indicated by the dash-dot line below beam 32), if necessary to accommodate heavier loading. In that case if the legs are shortened from the six foot configuration to the five foot configuration, it may be necessary to reorient the beam upside down to the position indicated by 32'. Attached at right angles to the end of the beam brace 32 are stubs 74 having at least one hole drilled at either end thereof. As illustrated in FIG. 1, two sets of holes are drilled in the flanges, but only two bolts 76 per stub are actually utilized. In lighter-weight applications, or with shorter legs, the stub 74 on the beam 32 can be omitted and instead holes can be drilled in the end of the beam 32 (see FIG. 16). On the shorter legs as shown in FIG. 9, a beam 32*b* can be utilized by bolting directly to the free blunted portions 58 by bolts 64.

Figure 10:
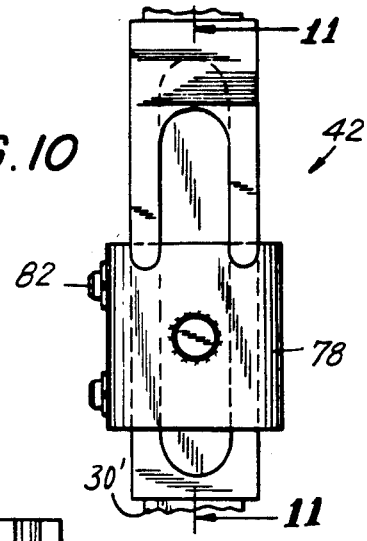
FIG. 10 is a front elevational view of a conventional slide lock with a special mounting clip providing adjustable positioning thereof on said triangular braces.
Figure 11:
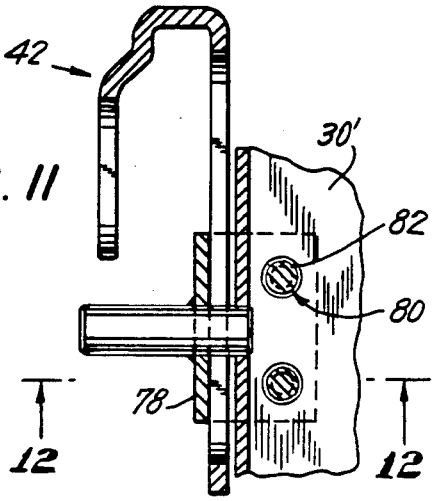
FIG. 11 is a vertical cross-section taken along lines 11—11 in FIG. 10.
Figure 12:
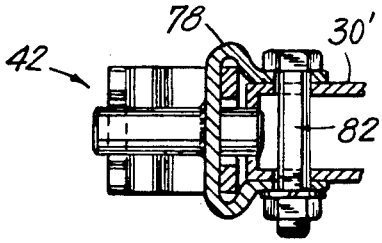
FIG. 12 is a horizontal cross-section taken along lines 12—12 in FIG. 11.
Figure 13:
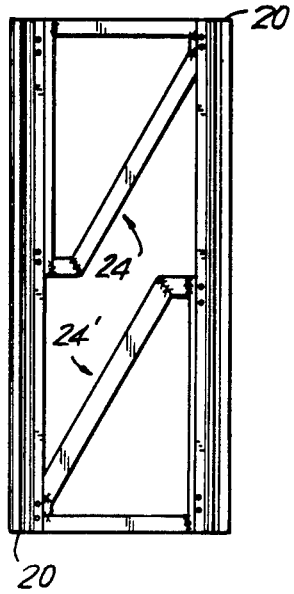
FIGS. 13 to 16 are simplified front elevational views showing alternative asymmetrical methods of assembly for achieving bolted shoring of still different widths in the load-bearing legs (these may require some additional bolt holes in the load-bearing legs from those of the embodiments illustrated above).
Figure 14:
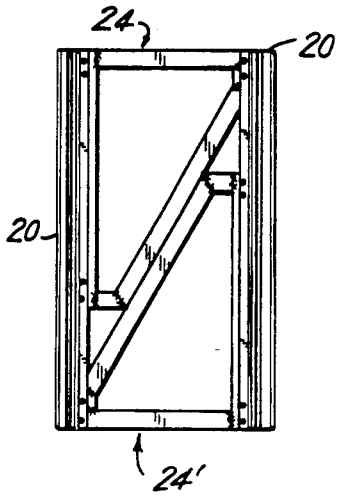
Figure 15:
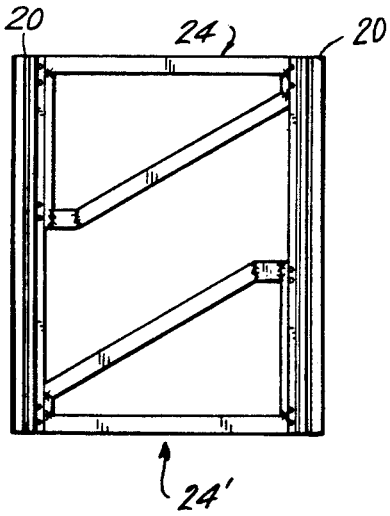
Figure 16:
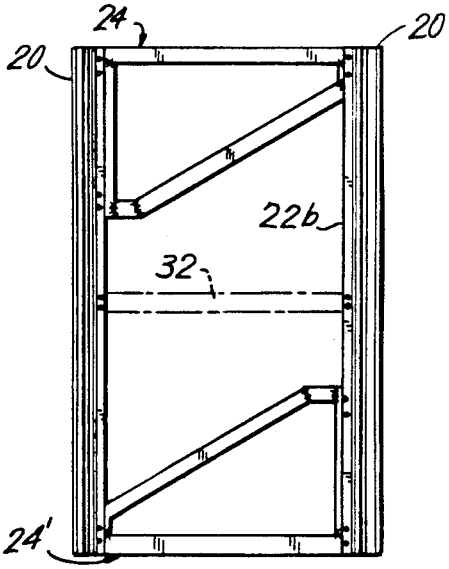

The slide lock 42 in FIGS. 10 to 12 is of a conventional type and will be described only with respect to the mounting strap 78 which has bolt holes 80 for bolt holes 82. As shown in FIGS. 9 and 12, this slide lock 42 is mounted on leg 30' through holes 50' of brace 24'.

For use with light loads and/or for use as scaffolding, the lower beam brace 32 etc. can be omitted entirely. This facilitates the size and adjustment capability by avoiding having to stock different size beams for such applications.

We claim:

1. A shoring frame brace, comprising said brace being constructed substantially from aluminum rectangular tubing in the form of a right non-isosceles triangle with the acute angled apices formed with short blunted portions at right angles to the respective adjacent leg, each such portion having a pair of lateral bolt holes extending therethrough in a direction parallel to its adjacent leg, and additional pairs of bolt holes perpendicular to the plane of the triangular surface of said brace and through each of said legs at both the outer and the inner portion of each end thereof, all of said pairs of bolt holes being aligned along the length of said legs or of said portions, said outer pairs of holes being adapted for use in bolting said brace to flanges on a shoring frame leg, and said inner pairs of holes being adpated for use in bolting to a bracing stud mount.

2. A brace according to claim 1, wherein said inner perpendicular pairs of holes are each slightly offset away from the end of its respective leg relative to the corresponding outer pair of holes whereby any weakening effect of overlapping such holes is diminished, and a third pair of inner holes for use in mounting said stud mount when used with shorter frame legs is provided on each leg spaced slightly longitudinally removed from the other inner pair of holes at that end of a respective leg which intersects at right angles with the other leg.

3. A brace according to claim 1 or claim 2, wherein said blunted portions are made from a block of aluminum and additionally have inner and outer pairs of perpendicular holes therethrough.

4. A disassemblable, size adjustable, shoring frame system comprising the following structural elements capable of being assembled in the field as a shoring frame:

a pair of load-bearing tubular frame legs each having an integral pair of parallel longitudinally-extending flanges;

bracing means for extending between and fastening to each of the frame legs by the respective flanges thereof with said frame legs parallel to each other, said bracing means including at least a pair of substantially identical right triangular braces, wherein at least the two apices of the triangular braces adjacent a hypotenuse thereof are blunted so as to form short blunted portions parallel to a brace leg opposite the blunted apex; and disconnectable fastening means for demountably joining said bracing means to the flanges of said legs.

5. A shoring frame system according to claim 4, wherein said bracing means has upper and lower portions, each portion being adapted to extend between and fasten to each of said legs by the respective flanges thereof with said legs parallel to each other.

6. A shoring frame system according to claim 5, wherein said triangular braces are non-isosceles, said fastening means comprise bolt holes in said flanges and perpendicular bolt holes in both ends of both legs of each of said triangular braces corresponding to selected ones of said holes in said flanges whereby said braces are adapted to be fastened to said flanges by either leg of each brace; the apex of each triangular brace is blunted at right angles to its adjacent leg and has at least one bolt hole through each blunted apex in a direction parallel to such adjacent leg whereby said braces are adapted to be fastened together as a pair at facing apices with the adjacent leg of one brace in line with the adjacent leg of the other brace.

7. A shoring frame system according to claim 6, wherein the blunted apices of said triangular braces also have perpendicular bolt holes therethrough adapted to align with selected ones of said holes in said flanges of said frame legs.

8. A shoring frame system according to claim 6, wherein said legs and braces are aluminum, and said bolt holes occur in pairs.

9. A shoring frame system according to claim 8, wherein said braces are made substantially from rectangular tubing.

10. A shoring frame system according to claim 9, wherein said upper bracing means comprise said pair of triangular braces, said lower bracing means comprise a rectangular aluminum tubular beam of a length determined by symmetrically aligning the legs of said pair of braces, said beam having stubs extending at right angles from either end with a bolt hole at each end of each stub and spaced to correspond to selected ones of said holes in said flanges.

11. A shoring frame comprising the components recited in claim 4 and assembled in accordance therewith, wherein said bracing means extends between parallel frame legs and is joined to said pairs of flanges.

12. A shoring frame according to claim 11, wherein bracing means consists of a single pair of non-isosceles triangular braces, which braces having said blunted portions at right angles to the respective brace leg braces are symmetrically fastened at said respective blunted apices with the adjacent legs in line and with the respective remaining legs each seated in between and fastened to a pair of flanges on the respective frame legs; said legs and braces being made of aluminum.

13. A shoring frame according to claim 11, wherein said bracing means has upper and lower portions, each portion being adapted to extend between and fasten to each of said legs by the respective flanges thereof with said legs parallel to each other.

14. A frame according to claim 13, wherein said triangular braces are non-isosceles.

15. A frame according to claim 14, wherein said upper bracing means consists of said pair of triangular braces which are symmetrically fastened together at said respective blunted apices with the adjacent legs in line and with the respective remaining legs each seated in between and fastened to a pair of flanges on respective frame legs.

16. A frame according to claim 15, wherein said bracing fastening means comprise bolt holes in said flanges and perpendicular bolt holes in both ends of both legs of each of said triangular braces corresponding to selected ones of said holes in said flanges and bolts removably securing said braces to said flanges through overlapping selected ones of said holes; said apex fastening means comprising at least one lateral bolt hole through each blunted apex portion of each triangular brace in a direction parallel to its adjacent brace leg.

17. A frame according to claim 16, wherein said bracing fastening means further comprises perpendicular bolt holes through the blunted apex portions of said triangular braces.

18. A frame according to claim 15, comprising at least four adjustably mountable bracing stud means secured to said each of said upper and said lower bracing means adjacent said frame legs.

19. A frame according to claim 18, wherein said legs and braces are aluminum and said braces are made substantially from rectangular tubing.

20. A frame according to claim 19, wherein said lower bracing means consists of a second pair of substantially identical triangular braces similarly symmetrically mounted as a bracing unit aligned between and fastened to the pairs of flanges of said respective frame legs.

21. A frame according to claim 20, wherein said bracing fastening means comprise bolt holes in said flanges and perpendicular bolt holes in both ends of both legs of each of said triangular braces corresponding to selected ones of said holes in said flanges and bolts removably securing said braces to said flanges through overlapping selected ones of said holes; said apex fastening means comprising at least one lateral bolt hole through each blunted apex portion of each triangular brace in a direction parallel to its adjacent brace leg; bolts fastening said triangular braces together in pairs through respectively aligned pairs of said lateral bolt holes.

22. A frame according to claim 19, wherein said lower bracing means consists of a rectangular aluminum tubular beam of a length determined by said aligned legs of said pair of braces, stubs extending at right angles from either end of said beam with each fastened in a respective pair of flanges such that said beam extends between said frame legs.

23. A frame according to claims 18, 19, or 22, wherein said bracing fastening means comprise bolt holes in said flanges and perpendicular bolt holes in both ends of both legs of each of said triangular braces corresponding to selected ones of said holes in said flanges and bolts removably securing said braces to said flanges through overlapping selected ones of said holes; said apex fastening means comprising at least one lateral bolt hole through each blunted apex portion of each triangular brace in a direction parallel to its adjacent brace leg; at least one bolt fastening said triangular braces together in a pair through at least one aligned pair of said lateral bolt holes.

24. A frame according to claim 23, wherein bolt holes occur in pairs.

25. A frame according to claim 22, wherein said bracing fastening means further comprises a bolt hole at each end of each stub, said holes on each stub being spaced to correspond to selected ones of said holes in said flanges, and bolts securing said stubs to said respective flanges.

26. A frame according to claim 22, wherein said beam is extendable in length so as to accommodate said pair of triangular braces being fastened with either their respective short legs aligned or their respective longer legs aligned.

27. A frame according to claim 14, wherein said bracing fastening means comprise bolt holes in said flanges and perpendicular bolt holes in both ends of both legs of each of said triangular braces corresponding to selected ones of said holes in said flanges and bolts removably securing said braces to said flanges through overlapping selected ones of said holes; said apex fastening means comprising at least one lateral bolt hole through each blunted apex portion of each triangular brace in a direction parallel to its adjacent brace leg.

28. A frame according to claim 27, wherein said bracing fastening means further comprises perpendicular bolt holes through the blunted apex portions of said triangular braces.

29. A frame according to claim 28, wherein said bracing fastening means further comprises bolts removably securing said triangular braces to a frame leg by passing through said perpendicular holes in said blunted portions and through overlapping holes in a pair of the frame leg's flanges.

30. A frame according to claims 21, 27, or 28, wherein bolt holes occur in pairs.

31. A disassemblable, size adjustable, shoring frame system comprising the following structural elements capable of being assembled in the field as a shoring frame:

a pair of load-bearing tubular frame legs each having an integral pair of parallel longitudinally-extending flanges;

bracing means for extending between and fastening to each of said legs by the respective flanges thereof with said legs parallel to each other, said bracing means including at least a pair of substantially identical right triangular braces, wherein at least the two apices of the triangular braces adjacent a hypotenuse thereof are blunted so as to form short blunted portions parallel to a brace leg opposite the blunted apex, the blunted portions and the brace legs each being of an appropriate width to fit between the two parallel flanges of the frame legs; and disconnectable fastening means for demountably joining said bracing means to the flanges of said legs, including bolt holes in said flanges, corresponding perpendicular bolt holes in the brace legs of each of the triangular braces by which the flanges of either leg of each brace can be fastened to said flanges, and perpendicular bolt holes through the blunted portions of said triangular braces to be aligned with selected ones of the bolt holes in the flanges of said frame legs.

* * * * *